United States Patent [19]

Versteegen

[11] Patent Number: 4,584,550

[45] Date of Patent: Apr. 22, 1986

[54] CONTACT PIECE FOR ESTABLISHING DELTA CIRCUITS ON THREE-LEGGED TRANSFORMERS

[75] Inventor: Petrus B. Versteegen, Malden, Netherlands

[73] Assignee: Smit Transformatoren B.V., Netherlands

[21] Appl. No.: 480,755

[22] Filed: Mar. 31, 1983

[30] Foreign Application Priority Data

Apr. 3, 1982 [DE] Fed. Rep. of Germany ..... 3212472

[51] Int. Cl.[4] ..... H01F 33/00

[52] U.S. Cl. ..... 336/10; 339/113 R; 339/157 R; 339/198 E

[58] Field of Search ..... 339/222, 198 J, 198 E, 339/198 C, 194 R, 150 T, 113 R, 113 B, 242, 157 R, 164, 36, 37; 174/59, 138 F, 72 C; 336/5, 10, 12

[56] References Cited

U.S. PATENT DOCUMENTS

| | | | |
|---|---|---|---|
| 839,260 | 12/1906 | Benson | 339/198 C X |
| 990,353 | 4/1911 | Gudeman | 339/198 C |
| 2,218,545 | 10/1940 | Monten | 339/157 R |
| 2,558,008 | 6/1951 | Smith | 339/150 T |
| 2,831,914 | 4/1958 | Jacobs | 339/198 E X |
| 2,964,726 | 12/1960 | Michals | 339/198 C X |
| 3,020,450 | 2/1962 | Shafer | 339/113 B X |
| 3,380,017 | 4/1968 | Gomulka | 339/242 X |
| 3,671,918 | 6/1972 | Mitchell | 339/157 R X |
| 4,315,662 | 2/1982 | Greenwood et al. | 339/113 R X |

FOREIGN PATENT DOCUMENTS

| | | | |
|---|---|---|---|
| 1971623 | 5/1967 | Fed. Rep. of Germany . | |
| 2139663 | 2/1973 | Fed. Rep. of Germany . | |
| 1116385 | 5/1956 | France | 339/157 R |
| 1118180 | 6/1956 | France | 339/137 R |

*Primary Examiner*—Thomas J. Kozma

*Attorney, Agent, or Firm*—Cushman, Darby & Cushman

[57] ABSTRACT

A connecting member for establishing delta circuits in a three-legged transformer includes a body formed from a mass of insulating material and having first, second and third pairs of opposing, radially extending connecting elements and electrically conductive members housed in the body and the pairs of electrical communication and for establishing a predetermined delta circuit when said pairs of connecting elements are electrically connected to the transformer terminals. Visual markings and/or window areas can be provided to permit visual determination of the first, second and third paths.

9 Claims, 9 Drawing Figures

Fig. 5a
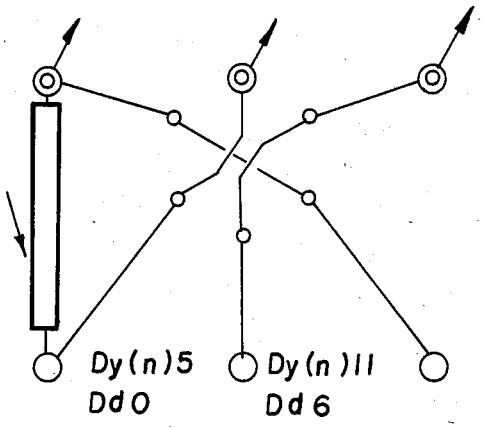
Fig. 5b
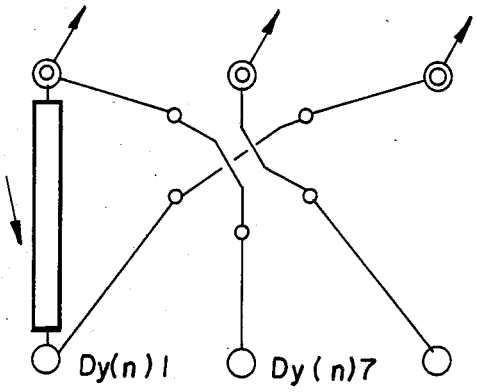
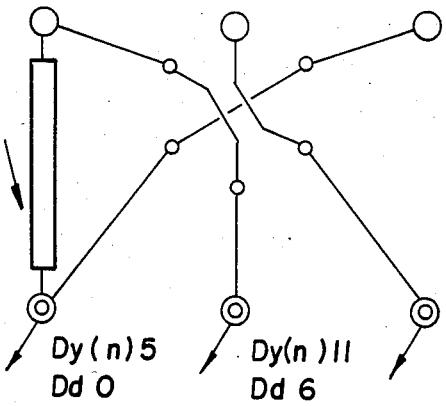
Fig. 5c
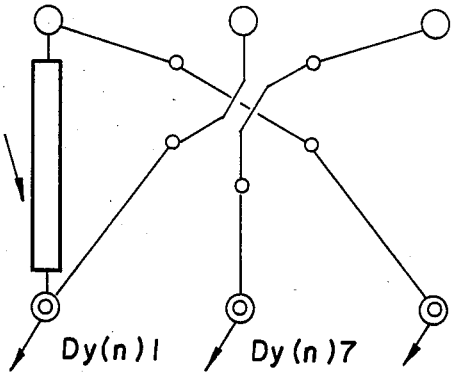
Fig. 5d

CONTACT PIECE FOR ESTABLISHING DELTA CIRCUITS ON THREE-LEGGED TRANSFORMERS

BACKGROUND AND SUMMARY OF THE INVENTION

The present invention relates to a contact piece consisting of an insulating mass for establishing delta circuits on three-legged transformers, especially for the predetermined interconnection of the high end voltage windings of three-phase current, air-cooled transformers of the type having six connecting elements on the exterior surface thereof.

The winding connecting contacts of high end voltage windings of transformers are normally located at the ends of the windings. Consequently, the distance between the connecting contacts of each phase or of the contacts between the phase for transformers of different types and sizes are typically unequal. This is true especially for air-cooled transformers which are made in accordance with the so-called wet winding process.

Heretofore, the connections of such winding connecting contacts have conventionally been produced by providing properly dimensioned conducting wires, whereby attention was paid to the fact that a sufficient air gap must be maintained in the crossing point so that sparkover or creeping current would be prevented with a high degree certainty. Furthermore, it has been known to use switching strips in cast resin transformers which are always provided with six connecting elements (connecting contacts) on the exterior thereof (see, German Utility Pat. No. 1,971,623 . Generally however, conventional switching strips may not be used for air-cooled transformers produced by the wet winding process since the connecting contacts are always located at the foot and at the head of windings. The known connecting strips are also not advantageous for the connections of high end voltage windings since for transformers of various types and sizes, various switching strips must always be maintained in inventory storage.

Therefore, the task arises of providing a contact piece for establishing delta circuits, especially for the connection of the high end voltage windings of air-cooled transformers, which may be mounted in a simple manner and is suitable for various types, sizes and kinds of windings.

This task is solved by the contact piece of the present invention wherein six connecting elements are disposed in the general shape of a star and are connected to one another by a centrally located base body having conducting lines embedded therein. The connecting contacts at the distal ends of the connecting elements themselves maintain the required minimum distance for the prevention of creeping currents and spark-over.

The term "connecting elements" as used herein and in the accompanying claims also includes the possibilities that the connecting contacts either outwardly project for a short distance from the base body or are peripherally countersunk into the base body.

Preferably, the conducting cables embedded inside the base body are connected in such a manner that the connecting elements as numbered clockwise in accompanying figures with Roman Numerals I, II, III, IV, V and VI are always interconnected in pairs and, more particularly, $16_I$ is connected with with $16_V$; $16_{II}$ is connected $16_{IV}$; and $16_{III}$ is connected with $16_{VI}$. With this configuration of the conducting cables, it is possible, as will be explained in more detail below, to establish various circuits customary in the field of transformer construction merely by selecting the specific orientation of the connecting element of the present invention relative to the contacts of the transformer. Thus, the same connecting element may be utilized to achieve various circuit configurations. The outside lying connecting contacts at the distal ends of the connecting element are electrically interconnected in pairs with the winding connecting contacts by conventional insulated and correspondingly extended connecting cables.

Preferably, the connecting elements are disposed in a radially symmetrical manner and thus all connecting elements may be electrically charged simultaneously. Preferably, the base body has a cylindrical or hexagonally-prismatic shape in which the conductive cables are embedded. The peripheral connecting members are molded with the base in a star-shaped arrangement through which each of the conductive cables can be extended. By virtue of the connecting members and the base body, a preferred one-piece cable support is established.

Transparent areas or window areas are preferably provided in the upper side of the cable support member or in the base body so that the course of the embedded calbes can be readilly identified to facilitate installation. It is also possible to apply cable-like markings on the upper side of the cable support or base body to correspond to the course of the embedded cables. These markings may take the form of etchings of a characteristic depth on the upper side of the cable support. With the aid of the window area or markings, one may thus readily recognize at a glance the manner in which the cable lie with respect to the three transformer windings.

BRIEF DESCRIPTION OF THE ACCOMPANYING DRAWING

Further characteristics and advantages of the contact piece according to the present invention will be explained in greater detail below with respect to a particularly preferred exemplary embodiment thereof which is depicted in the accompanying figures.

FIG. 1 shows the front view of an air-cooled transformer having circuit lines for the high end voltage windings;

FIG. 2*a* shows a top view of a circuit arrangement with the cable support;

FIG. 2*b* shows a side view of the FIG. 2*a* circuit lines;

FIGS. 5*a–d* show various examples of the connection possibilities when utilizing the connecting piece of the present invention.

DETAILED DESCRIPTION OF THE PREFERRED EXEMPLARY EMBODIMENT

Figure 1:
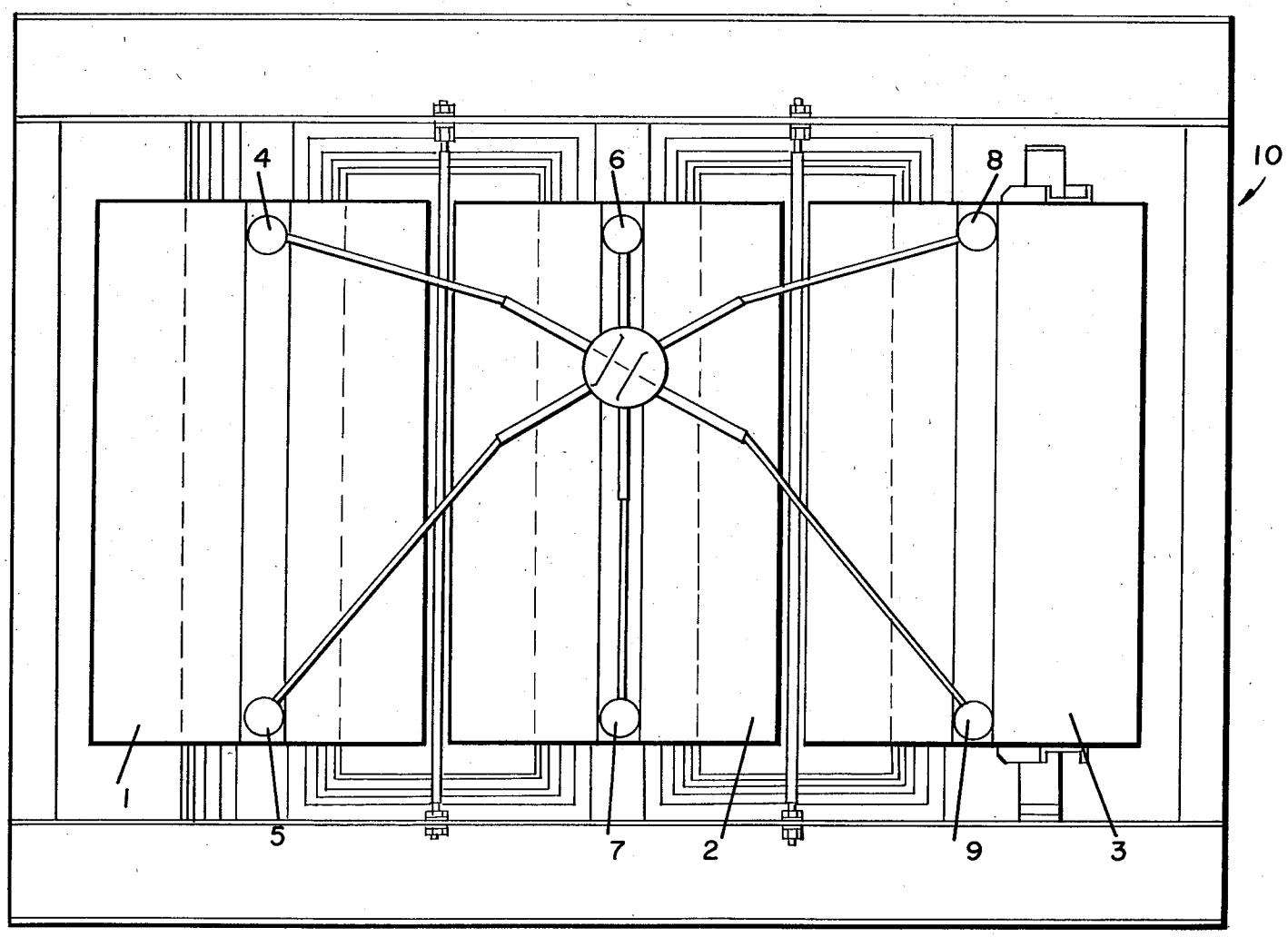

FIG. 1 shows an air-cooled transformer 10 equipped with three windings 1, 2, and 3. In the case of the windings 1–3, the connecting contacts of the high end voltage windings are always disposed at positions 4, 5; 6, 7 and 8, 9, respectively.

Figure 2B:
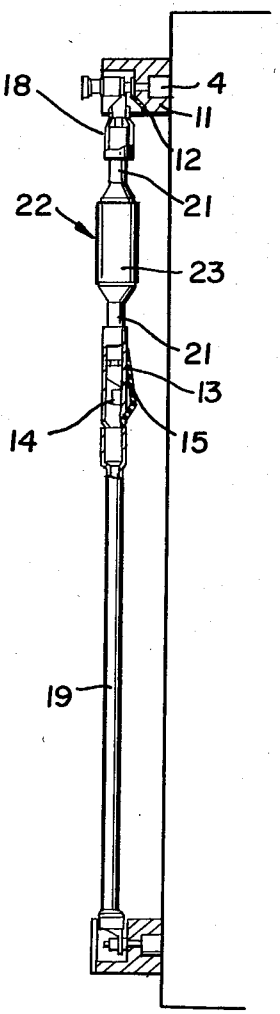
Figure 2A:
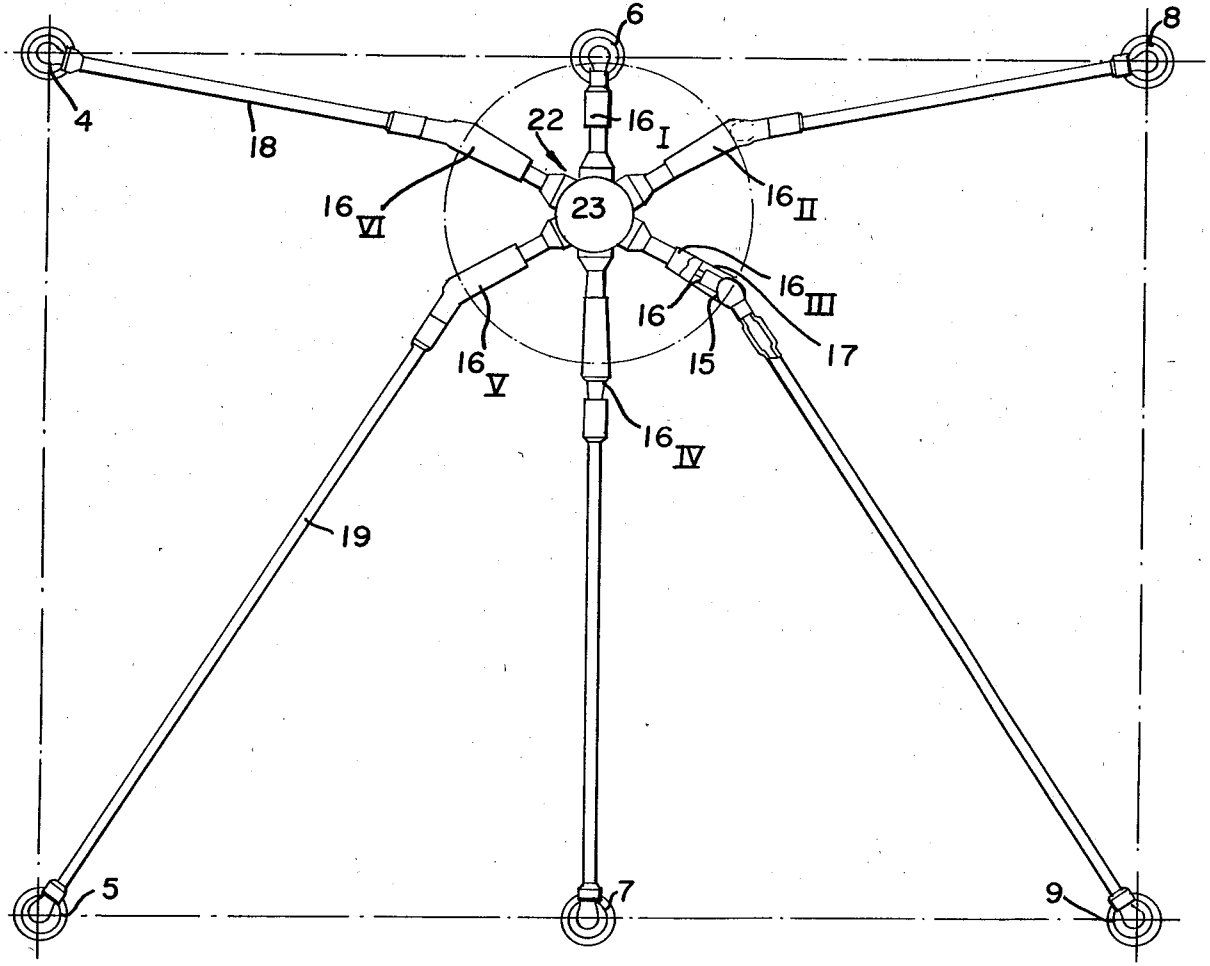

Connecting contacts 4–9 are typically surrounded by a plastic, protective body 11 and are connected in a well known manner to a connecting eye 12 which is a component of a connecting terminal, by an insulated connecting cable 18. (See FIGS. 2*a* and 2*b*). The connecting cable 18, in turn, terminates in a screw terminal connection 14, which itself is protected by an insulating jacket 13. Connecting contact 15 forms the end of an insulated connecting element 16, the former being electrically coupled to cable 18 via terminal 14 to establish electrical communication therewith.

Figure 3:
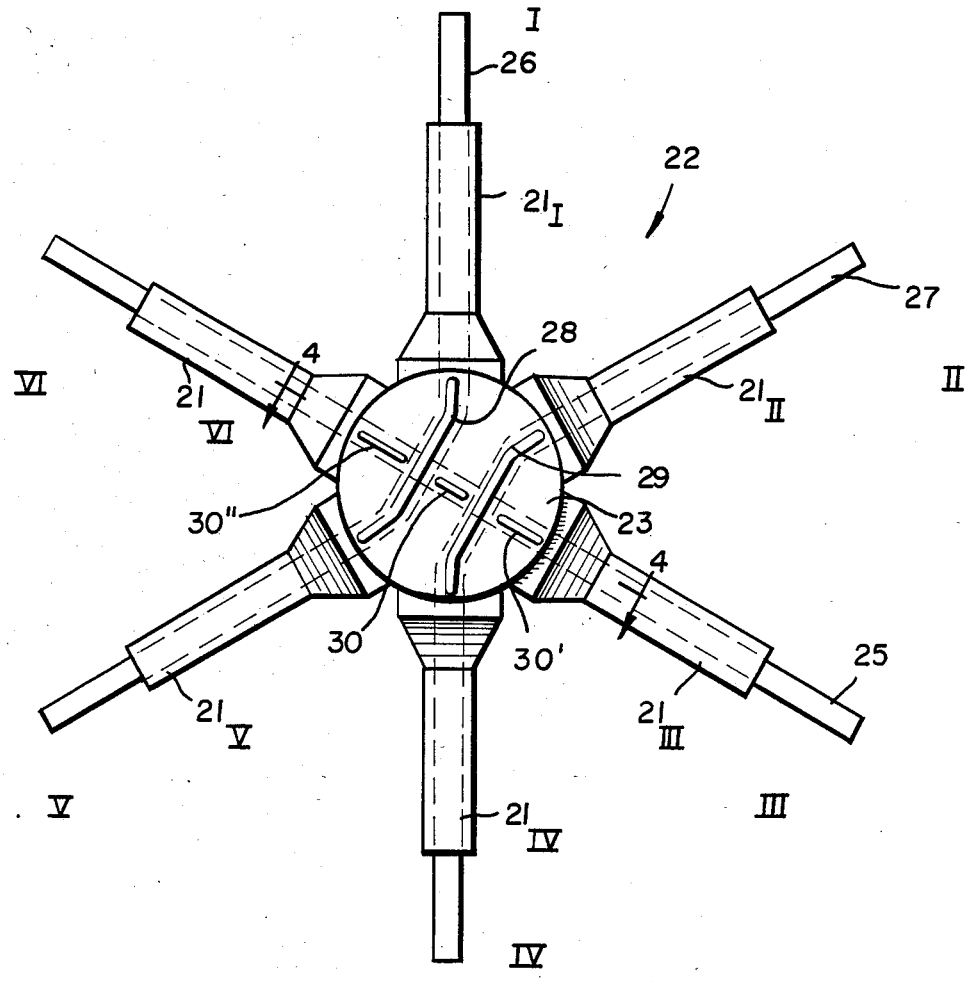
FIG. 3 is a detailed top view of a connecting piece according to the present invention.

Referring to FIG. 3, the connecting cables 18, 19 of all connections 4–9 respectively terminate at corresponding connecting elements 16: e.g. $16_I$, $16_{II}$, $16_{III}$, $16_{IV}$, $16_V$, $16_{VI}$. The cables of the connecting elements 16, in turn, are housed in holding supports $21_I$–$21_{VI}$ molded on peripheral sides of base body 23 in a radially symmetrical manner. The base body 23 with the six holding supports 21 together form cable support 22. The base body 23 itself may be any desired shape such as, for example, cylindrical or hexagonally prismatic.

Cables 25, 26, and 27 are preferably embedded in holding supports 21 and continue through the base body 23 in a predetermined arrangement. Base body 23 may be produced with the cables 25, 26, and 27 embedded therein in accordance with one of the known forming processes, for example, by way of injection molding, or die casting with cold-hardening cast resin in an open casting process or with hot-hardening cast resin in a vacuum. It is also possible to produce the base body 23 in mated upper and lower portions which together define channels in which cables 25, 26 and 27 are placed prior to assemblage.

The holding supports $21_I$–$21_{VI}$ with the cables therein are provided at each of their ends with plastic jackets 17 through which the cables are extended and respectively terminate at connecting contacts 15. Thus, six connecting elements $16_I$–$16_{VI}$ are formed. The connecting contacts 15 themselves maintain the required minimum distance to prevent creeping currents and spark-over. Consequently, the entire structure comprising the base body 23 and the connecting elements 16, as can be seen from accompanying FIGS. 2*a* and 2*b*, constitute an approximately star-shaped arrangement having the base body 23 in the center. It is important that the distances and arrangements of the cables and contacts are not only dimensioned for a certain circuit configuration are also capable of occupying and establishing any preselected circuit configuration known for air-cooled transformers.

Figure 4:
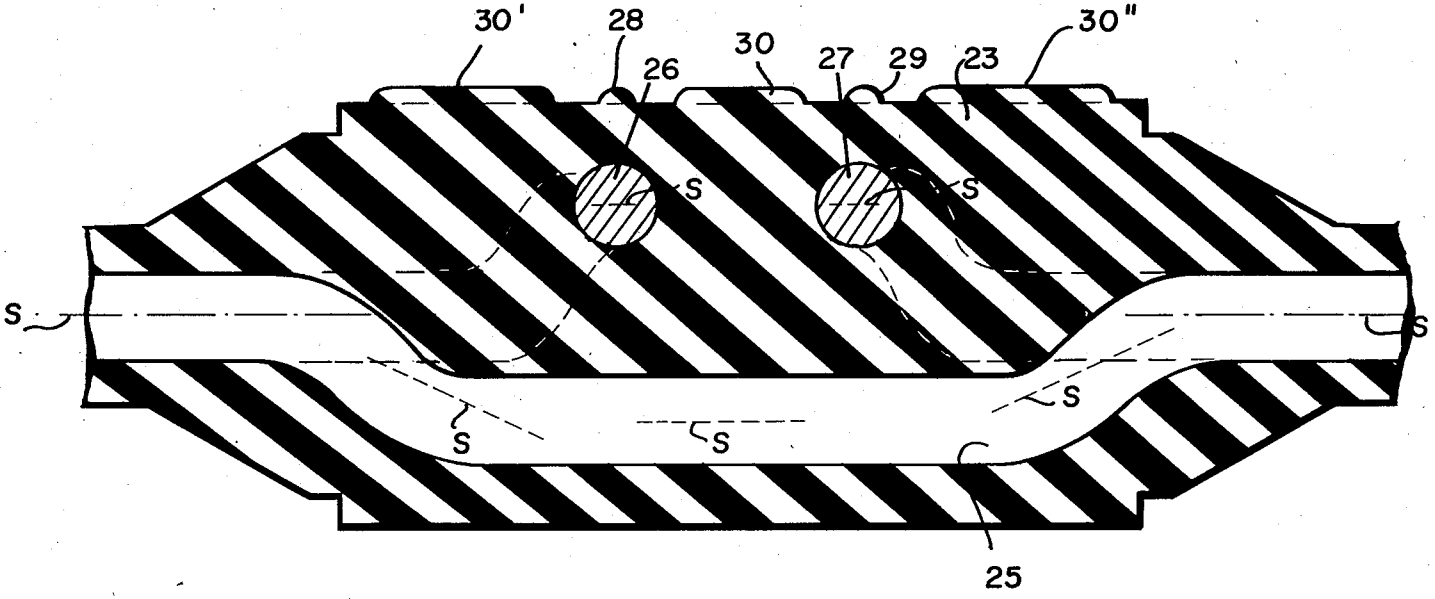
FIG. 4 is a cross-sectional view of the contact piece of the present invention taken along line 4—4 in FIG. 3.

FIGS. 3 and 4 show an enlarged view of the cable support 22 with the base body 23. For ease of presentation, the elements which have already been described above have been given the same reference numerals as in the FIGS. 1 and 2. From FIGS. 3 and 4, it is readily apparent that the cables in base body 23 and holding supports $21_I$–$21_{VI}$ are interconnected in pairs such that a continuous path of current is established. In particular, the interconnections of elements 16 is as follows:

$16_I$ is connected with $16_V$;
$16_{II}$ is connected with $16_{IV}$; and
$16_{III}$ is connected with $16_{VI}$.

FIG. 4 shows a cross-sectional view through a portion of the cable support 22 and especially through the base body 23. Two cables 26, 27 lying side by side are preferably embedded in the base body 23 and a cable 25 disposed transversely to cables 26, 27 lies in the bridging area therebelow.

Raised marking surfaces 28, 29, 30, 30′ and 30″ are formed on the upper side of the cable support 22 or the base body 23 and respectively identify the positions of embedded cables 25, 26, 27 along a characteristic level of cut (line cut S). Thus, the marking surfaces 30, 30′ and 30″ together identify the position of cable 25 while the marking surfaces 28 and 29 respectively identify cables 26 and 27. As a result of the marking surfaces 28–30″, which may also be established by corresponding window areas or slots formed in the top side of the cable support 22, it will be possible to readily identify the particular position and course of each of the cables 25, 26 and 27 within the base body 23. As a result, it is possible for a person to determine at a glance the particular circuit arrangement of the pertinent transformer. It is also possible to produce the base body from a transparent material, whereby the positions and courses of cables 25, 26 and 27 would similarly be readily identifiable.

According to further characteristics of the present invention, the connecting contacts 15 could be provided in the form of small threaded members, as brackets, eyes, wire hooks or the like. The connecting lines 19 between the connecting contacts 15 of line support 22 and the connecting contacts 4–9 of the windings 1–3, respectively are customarily in the form of conductive strips but could also be shaped in the form of conductive wires or bars.

FIGS. 5*a* to 5*d* show various circuit configurations achievable when utilizing the above-described contact piece in accordance with the present invention. In FIGS. 5*a* and 5*b*, the corresponding symbols of the transformer circuit configuration have been utilized. In detail FIG. 5*a* shows the circuit according to

| | | | |
|---|---|---|---|
| Dy (n) | 5 | Dy (n) | 11 |
| Dd | 0 | Dd | 6 |

FIG. 5*b* shows the circuit according to Dy(n) 1 Dy(n) 7.

FIG. 5*c* shows the circuit according to

| | | | |
|---|---|---|---|
| Dy (n) | 5 | Dy (n) | 11 |
| Dd | 0 | Dd | 6 |

FIG. 5*d* shows the circuit according to Dy(n) 1 Dy(n) 7.

Since FIGS. 5*a*–5*d* are schematic representations, the reader may wish to refer to FIGS. 14 so as to glean particular structural elements therefrom.

As the reader may now appreciate the connecting piece of the present invention provides versatility which is believed to have been unavailable in the prior art. Thus, by the selection of the position of the connecting piece of the present invention relative to the terminals on an air-cooled transformer, various circuit configurations can be achieved. Moreover, by utilizing suitable markings, the relative positions of the conductive cables can be readily determined.

What is claimed is:

1. A connecting member for establishing delta circuits on a three-legged transformer of the type having three pairs of connecting terminals corresponding to the high end voltage windings of a three-phase current, said member comprising:

a body formed from a mass of an insulating material;

first, second and third pairs of opposing connecting elements integrally molded with said body so as to radially extend symmetrically about the center of said body;

electrically conductive means embedded in said mass of insulating material and housed within said first, second and third pairs of connecting elements for defining first, second and third discrete paths of electrical communication and for establishing a predetermined delta circuit when said pairs of connecting elements are electrically connected to said transformer terminals, wherein said conducting means includes first, second and third cables and wherein said first cable is associated with said first pair of opposing connecting elements, said second cable is associated with one of the connecting elements of said second pair on one lateral side of said first pair and with one of the connecting elements of said third pair on the other lateral side of said first pair, and said third cable is associated with the other of the connecting elements of said second pair and the other of the connecting elements of the third pair, wherein said second and third cables each include respective end portions and a center portion, said center portions of said second and third cables being disposed in said body substantially parallel to one another and are each substantially transversely disposed relative to a center portion of said first cable, said center portions of said second and third cables being vertically displaced from and bridging said center portion of said first cable, wherein selective positioning of said body responsively positions said first, second and third cables relative to a respective one of said three pairs of connecting terminals of said three-legged transformer so that a selected delta circuit is established

2. A connecting member as in claim 1 wherein said body is cylindrical.

3. A connecting member as in claim 1 wherein said body is hexagonal in shape.

4. A connecting member as in claim 1 wherein said body includes visual means for visually indicating said first, second and third discrete paths and for permitting visual inspection of the course of said paths.

5. A connecting member as in claim 4 wherein said visual means comprise means defining window areas in the top surface of said body.

6. A connecting member as in claim 4 wherein said visual means is provided by a transparent material, said body consisting essentially of said material.

7. A connecting member as in claim 4 wherein said visual means comprise means defining raised marking surfaces.

8. A connecting member as in claim 1 wherein said conducting means is imbedded in said body.

9. A three-legged transformer including three pairs of connecting terminals corresponding to the high end voltage windings of a three-phase current, and a connecting member for establishing a predetermined delta circuit, said member comprising:

a body formed from a mass for an insulating material;

first, second and third pairs of opposing connecting elements integrally molded with said body so as to radially extend symmetrically about the center of said body; and electrically conducting means embedded in said mass of insulating and housed within said first, second and third pairs of connecting elements defining first, second and third discrete paths of electrical communication and for establishing a predetermined delta circuit when said pairs of connecting elements are electrically connected to said transformer terminals, wherein said conductive means includes first, second and third cables and wherein said first cable is associated with said first pair of opposing connecting elements, said second cable is associated with one of the connecting elements of said second pair on one lateral side of said first pair and with one of the connecting elements of said third pair on the other lateral side of said first pair, and said third cable is associated with the other of the connecting elements of said second pair and the other of the connecting elements of said third pair, wherein said second and third cables include respective end portions and a center portion, said center portions of said second and third cables being disposed in said body substantially parallel to one another are each substantially transversely disposed related to a center portion of said first cable, said center portions of said second and third cables being vertically displaced from and bridging said center portion of said first cable, wherein selective positioning of said body responsively positions said first, second and third cables relative to a respective one of said three pairs of connecting terminals to establish said selected delta circuit.

* * * * *